US010458157B2

(12) United States Patent
Kimura

(10) Patent No.: US 10,458,157 B2
(45) Date of Patent: Oct. 29, 2019

(54) VEHICLE DOOR LOCK DEVICE

(71) Applicant: MITSUI KINZOKU ACT CORPORATION, Kanagawa (JP)

(72) Inventor: Shuntaro Kimura, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 354 days.

(21) Appl. No.: 15/541,323

(22) PCT Filed: Apr. 5, 2016

(86) PCT No.: PCT/JP2016/061171

§ 371 (c)(1),
(2) Date: Jun. 30, 2017

(87) PCT Pub. No.: WO2017/006602

PCT Pub. Date: Jan. 12, 2017

(65) Prior Publication Data

US 2017/0370130 A1 Dec. 28, 2017

(30) Foreign Application Priority Data

Jul. 9, 2015 (JP) ..... 2015-137749

(51) Int. Cl.
*E05B 79/08* (2014.01)
*E05B 77/34* (2014.01)
(Continued)

(52) U.S. Cl.
CPC ..... *E05B 79/08* (2013.01); *E05B 77/34* (2013.01); *E05B 81/06* (2013.01); *E05B 81/16* (2013.01);
(Continued)

(58) Field of Classification Search
CPC ..... E05B 79/08; E05B 79/00; E05B 79/10; E05B 79/12; E05B 77/34; E05B 77/48; E05B 81/00; E05B 81/06; E05B 81/16; E05B 81/54; E05B 81/64; E05B 81/66; E05B 81/68; E05B 81/70; E05B 81/72; E05B 81/74; E05B 85/02
USPC ..... 292/200
See application file for complete search history.

(56) References Cited

U.S. PATENT DOCUMENTS 8,810,164 B2 * 8/2014 Kamiya ..... E05B 81/20 318/62
8,894,104 B2 * 11/2014 Yokomori ..... E05B 81/38 292/199
(Continued)

FOREIGN PATENT DOCUMENTS

CN 102052022 A 5/2011
CN 102747896 A 10/2012
(Continued)

OTHER PUBLICATIONS

Chinese Office Action issued in corresponding Chinese Patent Application No. 201680004961.7, dated Sep. 3, 2018, with English Translation.
(Continued)

*Primary Examiner* — Nathan Cumar
(74) *Attorney, Agent, or Firm* — McDermott Will & Emery LLP

(57) ABSTRACT

A vehicle door lock device includes: a connecting portion to which a connector for connection to an external device is connected; a casing; a latch mechanism that is arranged at a rear end portion of the casing in a vehicle front-rear direction and includes a latch and a ratchet; a locking and unlocking mechanism arranged in the casing, the locking and unlocking mechanism including: a lever lock that switches between transmitting or not transmitting a door opening operation to the latch mechanism according to a rotational position; and a motor that drives the lever lock; a first switch that detects a rotational position of the lever lock; a second switch that detects a rotational position of the latch; and a connecting unit that electrically connects the connecting portion to the motor, the first switch and the second switch.

8 Claims, 16 Drawing Sheets

(51) Int. Cl.

| | |
|---|---|
| ***E05B 81/66*** | (2014.01) |
| ***E05B 85/02*** | (2014.01) |
| ***E05B 81/54*** | (2014.01) |
| ***E05B 81/06*** | (2014.01) |
| ***E05B 81/16*** | (2014.01) |
| ***E05B 81/64*** | (2014.01) |

(52) U.S. Cl.
CPC ..... *E05B 81/54* (2013.01); *E05B 81/64* (2013.01); *E05B 81/66* (2013.01); *E05B 85/02* (2013.01)

(56) References Cited

U.S. PATENT DOCUMENTS

| | | | | |
|---|---|---|---|---|
| 9,249,605 | B2 | 2/2016 | Yamagata et al. | |
| 2014/0000169 | A1* | 1/2014 | Yokomori ..... | B60J 5/00 49/349 |

FOREIGN PATENT DOCUMENTS

| | | | |
|---|---|---|---|
| JP | 09-096145 | A | 4/1997 |
| JP | 10-196182 | A | 7/1998 |
| JP | 2010-261308 | A | 11/2010 |
| JP | 2012-007342 | A | 1/2012 |
| JP | 2012-012180 | A | 1/2012 |
| JP | 2015-083733 | A | 4/2015 |

OTHER PUBLICATIONS

Decision to Grant issued in corresponding Japanese Patent Application No. 2015-137749, dated Jan. 17, 2017.
Search Report issued in corresponding International Patent Application No. PCT/JP2016/061171, dated Jun. 7, 2016.

* cited by examiner

VEHICLE DOOR LOCK DEVICE

CROSS REFERENCE

This application is the U.S. National Phase under 35 U.S.C. § 371 of International Application No. PCT/JP2016/061171, filed on Apr. 5, 2016, which claims the benefit of Japanese Application No. 2015-137749, filed on Jul. 9, 2015, the entire contents of each are hereby incorporated by reference.

FIELD

The present invention relates to a vehicle door lock device.

BACKGROUND

Door lock devices, which include switches that detect rotational positions of latches, have conventionally existed. For example, disclosed in Patent Literature 1 is technology related to a door latch control device including a rotary switch that detects change in rotational position of a latch around a latch shaft.

CITATION LIST

Patent Literature

Patent Literature 1: Japanese Laid-open Patent Publication No. 2010-261308

SUMMARY

Technical Problem

When the switch for detecting the rotational position of the latch is provided, wirings for that switch need to be provided in a casing. If the shapes of the wirings in the casing become complicated because of the provision of the switch, the cost of the door lock device may be increased, or the assembly efficiency may be reduced. For example, if the wirings are formed by punching, when the shapes of the individual wirings become complicated, waste of the material is increased and unit prices of the parts are increased.

An object of the present invention is to provide a vehicle door lock device that enables complication of shapes of wirings to be reduced.

Solution to Problem

A vehicle door lock device according to the present invention includes: a connecting portion to which a connector for connection to an external device is connected; a casing; a latch mechanism that is arranged at a rear end portion of the casing in a vehicle front-rear direction and includes a latch and a ratchet; a locking and unlocking mechanism arranged in the casing, the locking and unlocking mechanism including: a lever lock that switches between transmitting or not transmitting a door opening operation to the latch mechanism according to a rotational position; and a motor that drives the lever lock; a first switch that detects a rotational position of the lever lock; a second switch that detects a rotational position of the latch; and a connecting unit that electrically connects the connecting portion to the motor, the first switch and the second switch, wherein the connecting portion is arranged at a front portion in the vehicle front-rear direction on an outer surface of the casing, the motor and the first switch are arranged at a front portion in the vehicle front-rear direction in the casing, and the connecting unit includes: a first connecting unit that is arranged at a front portion in the vehicle front-rear direction in the casing and connects the connecting portion to the motor and the first switch; and a second connecting unit that is arranged at a rear portion in the vehicle front-rear direction in the casing and connects between the first connecting unit and the second switch.

In the above-described vehicle door lock device, the second connecting unit is arranged along a wall portion of an upper end of the casing in a vehicle up-down direction.

In the above-described vehicle door lock device, the first connecting unit and the second connecting unit are connected to each other at an upper end portion in the vehicle up-down direction in the casing.

In the above-described vehicle door lock device, the second switch detects that the rotational position of the latch is a position other than a fully latched position.

Advantageous Effects of Invention

A vehicle door lock device according to the present invention includes: a connecting portion that a connector for connection to an external device is connected to; a casing; a latch mechanism that is arranged at a rear end portion of the casing in a vehicle front-rear direction, and that has a latch and a ratchet; a locking and unlocking mechanism having a lever lock that switches over between transmitting or not transmitting a door opening operation to the latch mechanism according to a rotational position, and a motor that drives the lever lock, the locking and unlocking mechanism being arranged in the casing; a first switch that detects a rotational position of the lever lock; a second switch that detects a rotational position of the latch; and a connecting unit that electrically connects the connecting portion to the motor, the first switch, and the second switch.

The connecting portion is arranged at a front portion in the vehicle front-rear direction on an outer surface of the casing. The motor and the first switch are arranged at a front portion in the vehicle front-rear direction in the casing. The connecting unit has: a first connecting unit that is arranged at a front portion in the vehicle front-rear direction in the casing, and that connects the connecting portion to the motor and the first switch; and a second connecting unit that is arranged at a rear portion in the vehicle front-rear direction in the casing, and that connects between the first connecting unit and the second switch.

The vehicle door lock device according to the present invention provides an effect of being able to reduce complication of shapes of the wirings, because the connecting unit is divided into the first connecting unit and the second connecting unit.

DESCRIPTION OF EMBODIMENTS

Hereinafter, a vehicle door lock device according to an embodiment of the present invention will be described in detail with reference to the drawings. This invention is not limited by this embodiment. Further, components in the embodiment described below include those easily expected by any person skilled in the art or those substantially the same.

Figure 1:
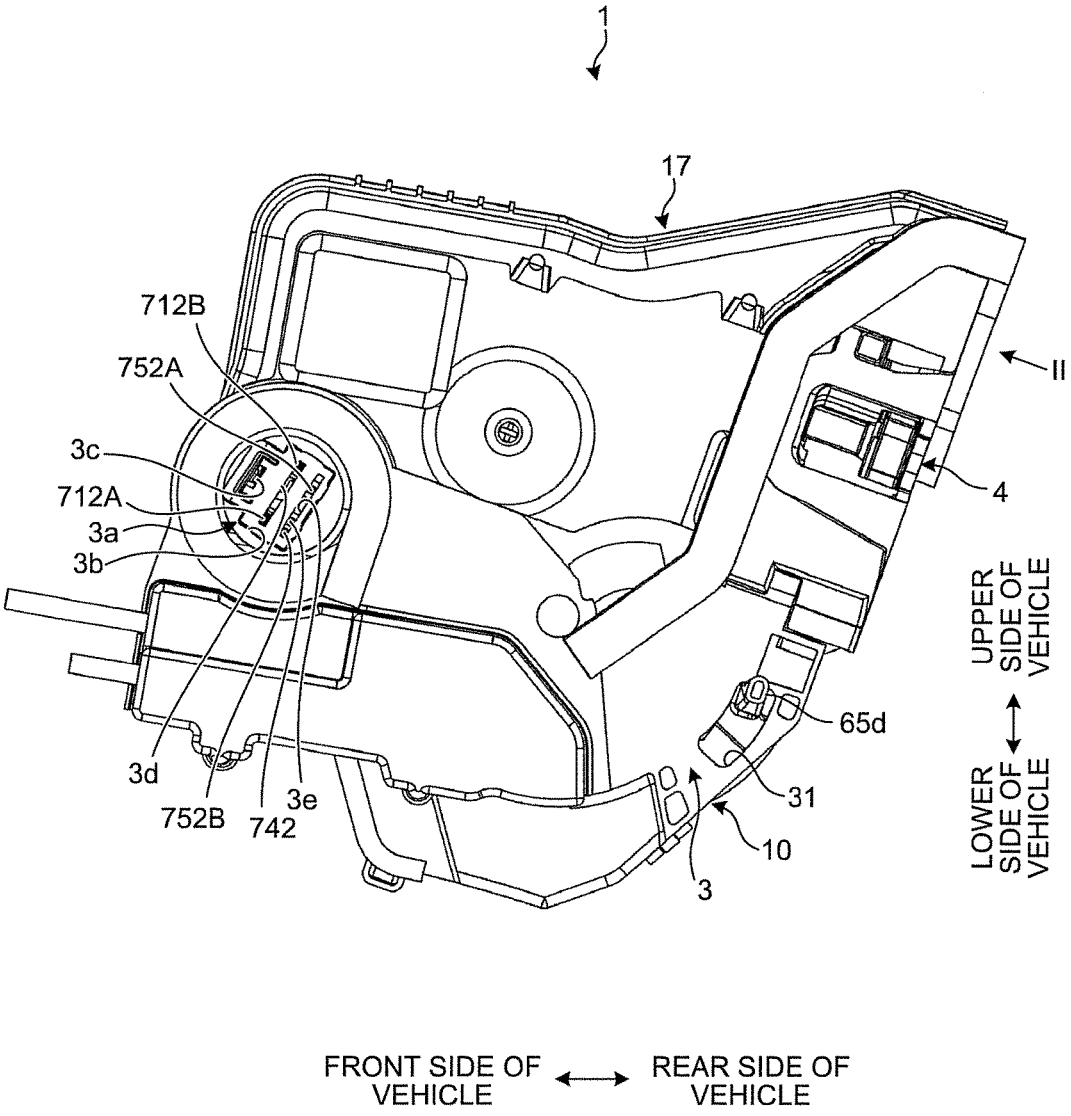
FIG. 1 is a front view of a vehicle door lock device according to an embodiment.
Figure 2:
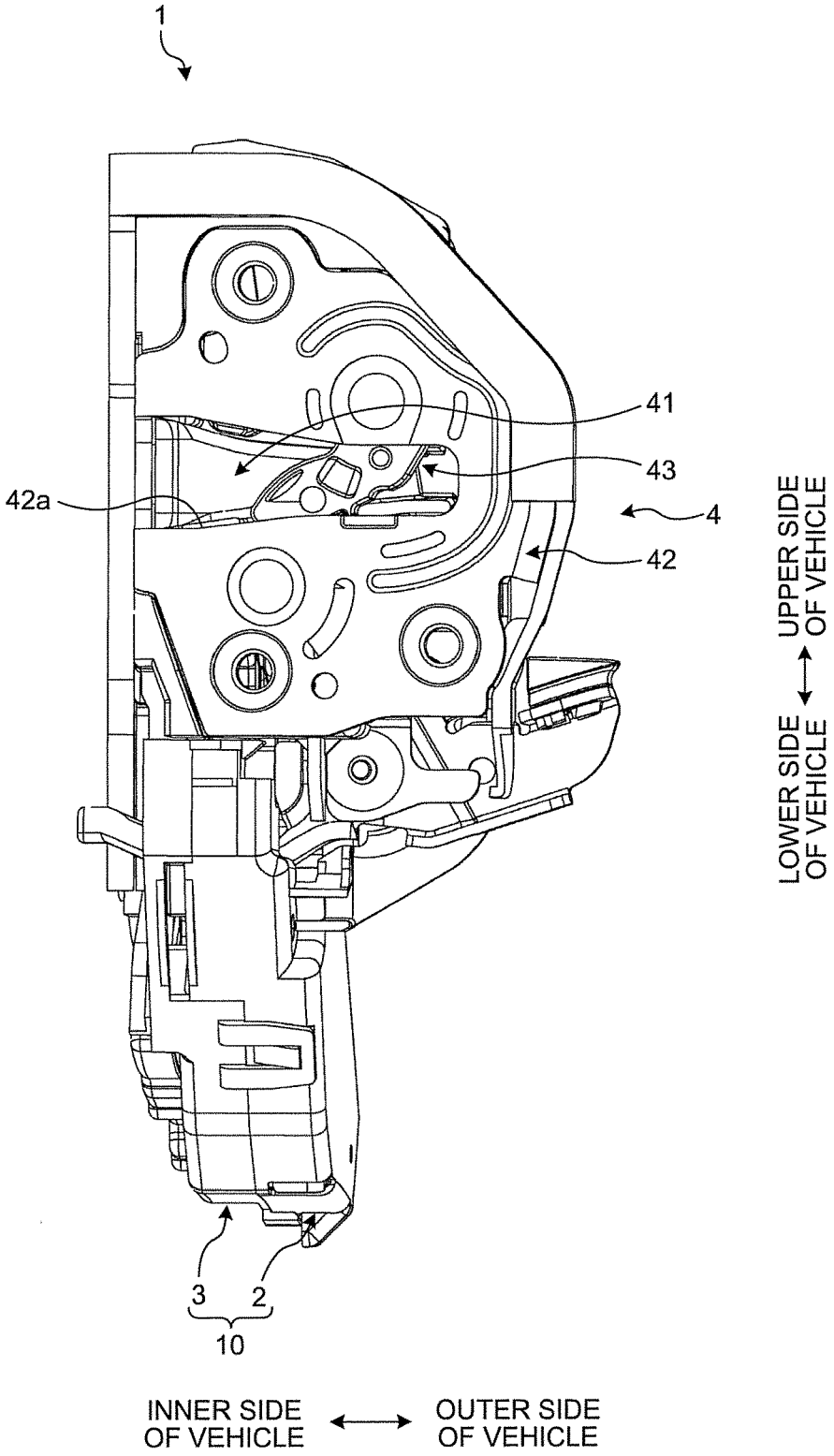
FIG. 2 is a side view of the vehicle door lock device according to the embodiment.

An embodiment will be described with reference to FIG. 1 to FIG. 16. This embodiment relates to a vehicle door latch device. FIG. 1 is a front view of a vehicle door lock device according to the embodiment, and FIG. 2 is a side view of the vehicle door lock device according to the embodiment. In FIG. 2, a side face as viewed in a direction II in FIG. 1 is illustrated.

Figure 3:
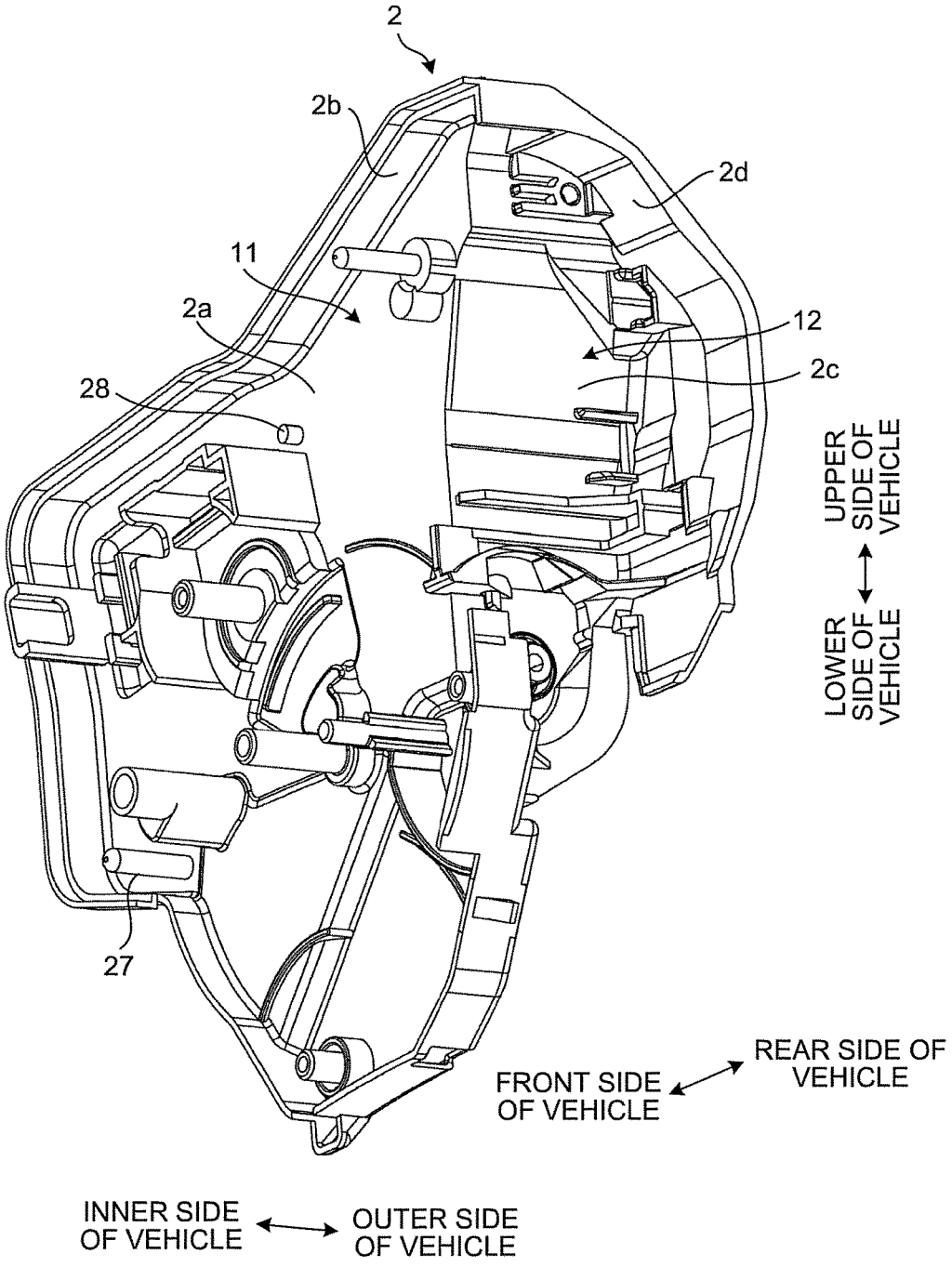
FIG. 3 is a perspective view of a first casing according to the embodiment.
Figure 5:
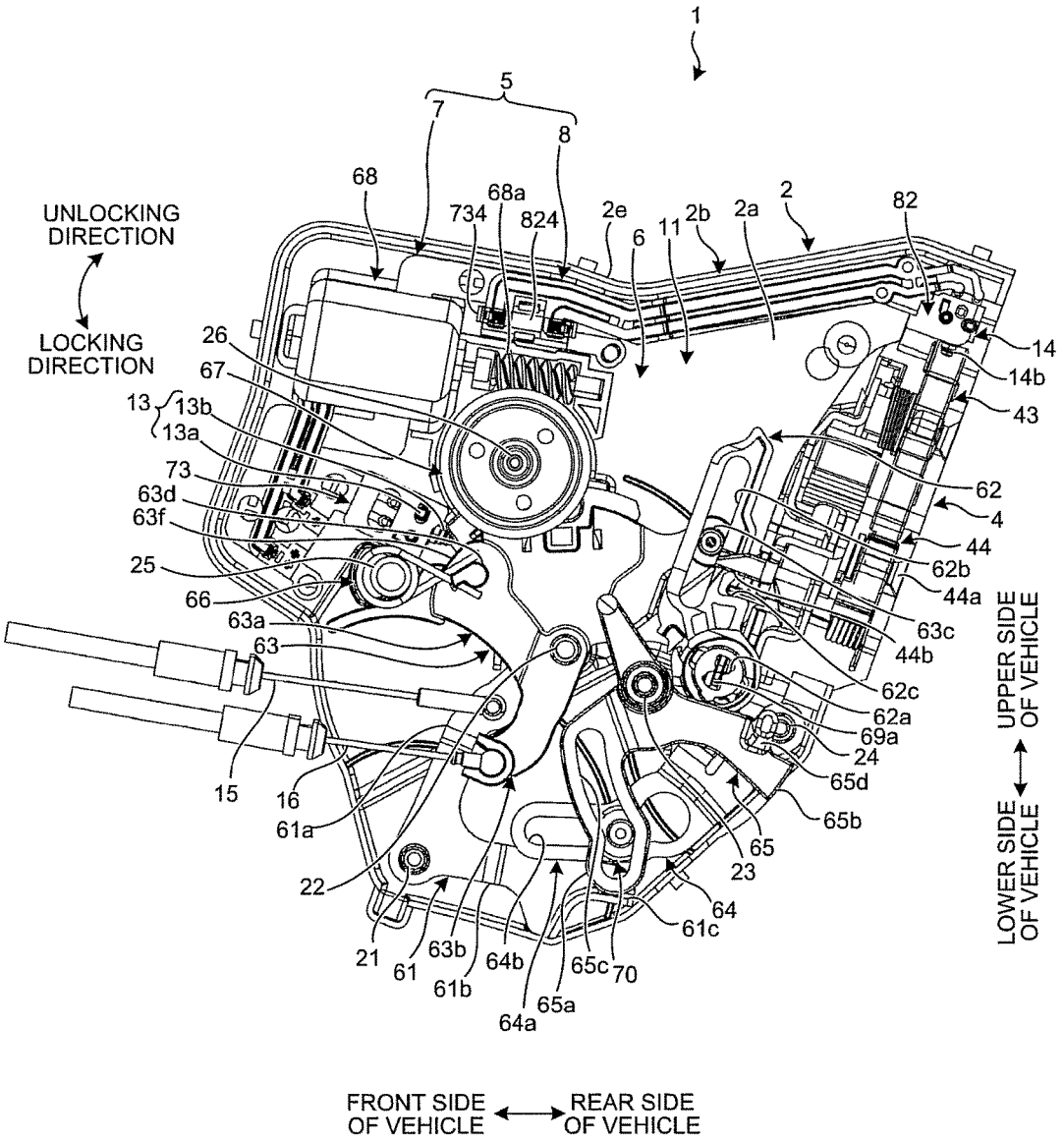
FIG. 5 is a front view illustrating the inside of the vehicle door lock device according to the embodiment.

A vehicle door lock device 1 of this embodiment has, as illustrated in FIG. 1, a casing 10, and a latch mechanism 4. The vehicle door lock device 1 further has a locking and unlocking mechanism 6, a first switch 13, a second switch 14, and a connecting unit 5 which are illustrated in FIG. 5 and the like. As illustrated in FIG. 2, the casing 10 has a first casing 2, and a second casing 3. The first casing 2 has, as illustrated in FIG. 3, a first accommodating unit 11 and a second accommodating unit 12. The first accommodating unit 11 is positioned at a fronter side of a vehicle than the second accommodating unit 12. In this specification, a vehicle front-rear direction refers to a front-rear direction of the vehicle in a state where the vehicle door lock device 1 has been installed in a door of the vehicle. Similarly, a vehicle up-down direction refers to an up-down direction of the vehicle in the state where the vehicle door lock device 1 has been installed in the door of the vehicle. Furthermore, a vehicle inner-outer direction is an inner-outer direction of the vehicle in the state where the vehicle door lock device 1 has been installed in the door of the vehicle, and is a direction orthogonally intersecting each of the vehicle front-rear direction and the vehicle up-down direction.

The first accommodating unit 11 is a spatial unit accommodating therein the locking and unlocking mechanism 6, and the second accommodating unit 12 is a spatial unit accommodating therein the latch mechanism 4. The first casing 2 has a first outer wall portion 2*a* and a first side wall portion 2*b*, which form the first accommodating unit 11. The first outer wall portion 2*a* is a wall portion intersecting the vehicle inner-outer direction, and for example, intersects the vehicle inner-outer direction substantially orthogonally. The first side wall portion 2*b* is a wall portion surrounding the first outer wall portion 2*a*, and protrudes toward an inner side of the vehicle from the first outer wall portion 2*a*. The first side wall portion 2*b* is provided continuously along an edge portion of an upper end, an edge portion of a front end, and an edge portion of a lower end, of the first outer wall portion 2*a*.

The first casing 2 has a second outer wall portion 2*c* and a second side wall portion 2*d*, which form the second accommodating unit 12. The second outer wall portion 2*c* is a wall portion intersecting the vehicle front-rear direction. The second outer wall portion 2*c* protrudes toward an outer side of the vehicle from a rear end of the first outer wall portion 2*a*. The second side wall portion 2*d* is a wall portion surrounding the second outer wall portion 2*c*, and protrudes toward a rear side of the vehicle from the second outer wall portion 2*c*. The second side wall portion 2*d* is continuously provided along an edge portion of an upper end and an edge portion of an outer side end portion, of the second outer wall portion 2*c*. The second accommodating unit 12 is a spatial unit at a rear end portion of the casing 10 in the vehicle front-rear direction.

Figure 4:
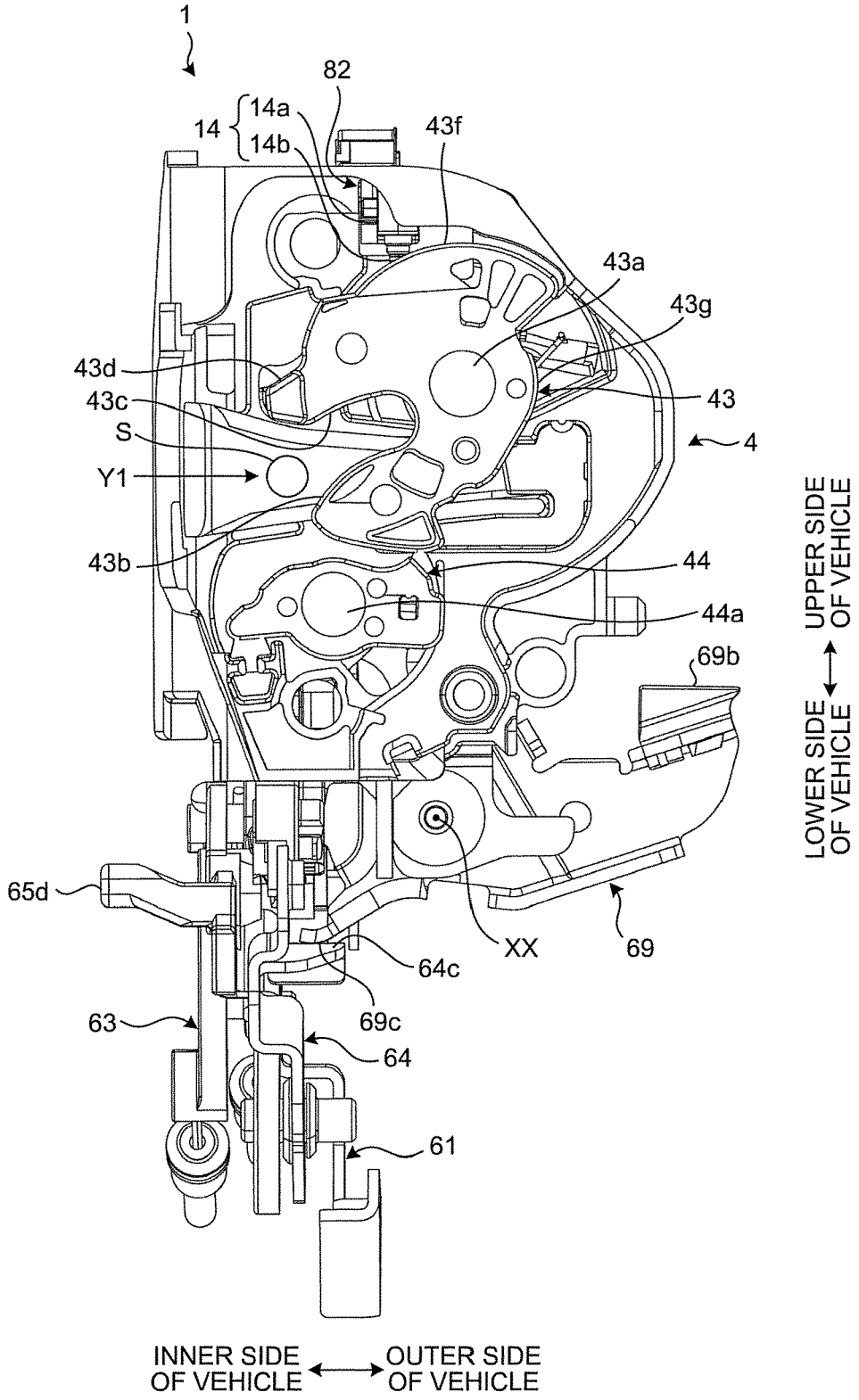
FIG. 4 is a side view of a latch mechanism and a locking and unlocking mechanism, of the embodiment.

The second casing 3 is a cover member that closes an opening at the inner side of the vehicle in the first casing 2. The second casing 3 forms, together with the first casing 2, an accommodating space that accommodates therein the locking and unlocking mechanism 6 and the latch mechanism 4. As illustrated in FIG. 2, the latch mechanism 4 has a body 41, and a cover plate 42. The cover plate 42 has an entrance groove 42*a*. The entrance groove 42*a* is a groove that a striker provided in the body of the vehicle is able to enter. As illustrated in FIG. 4, the latch mechanism 4 has a latch 43 and a ratchet 44. The latch 43 and the ratchet 44 are freely rotatably supported by a shaft 43*a* and a shaft 44*a*, respectively. The latch 43 is biased in a clockwise direction (opening direction) in FIG. 4 by a spring. The ratchet 44 is biased in an anticlockwise direction in FIG. 4 by a spring.

In FIG. 4, an unlatched state of the latch mechanism 4 is illustrated. When a striker S advances as illustrated with an arrow Y1 as the door is closed, the striker S abuts against an abutment portion 43*b* of the latch 43 and the latch 43 rotates in the anticlockwise direction (engaging direction). Thereby, the latch 43 engages with the striker S, and the striker S is held inside an engagement groove 43*c*. The ratchet 44 restricts rotation of the latch 43 in the opening direction by abutting against the latch 43 that is in a state of having rotated in the engaging direction. The ratchet 44 stops the latch 43 at a half latched position by abutting against the abutment portion 43*b* of the latch 43. When the ratchet 44 abuts against a projecting portion 43*d*, the latch 43 is stopped at a fully latched position.

As illustrated in FIG. 5, the locking and unlocking mechanism 6 has an inside lever 61, an open link 62, a lever lock 63, an intermediate lever 64, a coupling member 70, a childproof lever 65, a worm wheel 67, and a motor 68. The locking and unlocking mechanism 6 further includes an outside lever 69 illustrated in FIG. 4. Referring back to FIG. 5, the inside lever 61 is arranged at a lower end in the first accommodating unit 11. The inside lever 61 is freely rotatably supported by a first shaft 21 of the first casing 2. The inside lever 61 has a first arm 61*a*, a second arm 61*b*, and a pressing portion 61*c*. The first arm 61*a* extends toward an upper side of the vehicle from the first shaft 21. The first arm 61*a* is coupled to an inner handle of the door via a cable 15.

The second arm 61*b* extends toward the rear side of the vehicle from the first shaft 21. The pressing portion 61*c* is provided at an extended end portion of the second arm 61*b*.

The lever lock 63 is arranged at a vehicle front-rear direction and vehicle up-down direction central portion in the first accommodating unit 11. The lever lock 63 is freely rotatably supported by a second shaft 22 of the first casing 2. The lever lock 63 has a plate portion 63*a* positioned at the upper side of the vehicle with respect to the second shaft 22, and an arm 63*b* extending toward a lower side of the vehicle from the second shaft 22. The plate portion 63*a* is substantially fan-shaped in a planar view thereof, and has width that widens toward an outer side in a radial direction of the second shaft 22.

The plate portion 63*a* has a coupling projection 63*c* and an engagement projection 63*d* provided therein, which protrude toward the inner side of the vehicle. The coupling projection 63*c* is a cylindrically shaped projection, which is arranged at an end portion of the plate portion 63*a*, the end portion being at the rear side of the vehicle. The engagement projection 63*d* is a column shaped projection, which is arranged at an end portion of the plate portion 63*a*, the end portion being at a front side of the vehicle. The arm 63*b* is coupled to a lock knob of the door via a cable 16.

An over center spring 66 is a spring that provides biasing force in a rotating direction to the lever lock 63. The over center spring 66 is a coil spring, and both of ends of a wire forming a coil portion protrude outward from the coil portion and intersect each other. This intersecting portion is engaged with the engagement projection 63*d* of the lever lock 63. The over center spring 66 is supported by a spring shaft 25 of the first casing 2, and presses the plate portion 63*a* toward the rear side of the vehicle. The biasing force of the over center spring 66 is force that rotates the lever lock 63 in an unlocking direction. The unlocking direction of the lever lock 63 is a clockwise direction in FIG. 5.

The childproof lever 65 and the intermediate lever 64 are arranged at a lower portion at the rear side of the vehicle in the first accommodating unit 11. The childproof lever 65 is freely rotatably supported by a third shaft 23 of the first casing 2. The intermediate lever 64 is freely rotatably supported by a fourth shaft 24 of the first casing 2. The intermediate lever 64 has an arm 64*a*, and a coupling hole 64*b* provided in the arm 64*a*. The arm 64*a* extends toward the front side of the vehicle from the fourth shaft 24. The coupling hole 64*b* is a slit shaped through hole, which is formed with a predetermined length along a longitudinal direction of the arm 64*a*. A coupling member 70 is arranged in the coupling hole 64*b*. The coupling member 70 is a column shaped member, and is supported by the coupling hole 64*b*. The coupling member 70 is freely movable in the longitudinal direction of the arm 64*a* along the coupling hole 64*b*.

By moving the coupling member 70 according to an operation by a user, the childproof lever 65 switches over between validity and invalidity of a door opening operation on the inner handle. The childproof lever 65 has a first arm 65*a*, a second arm 65*b*, a coupling hole 65*c*, and a handle 65*d*. The first arm 65*a* extends toward the lower side of the vehicle from the third shaft 23. The coupling hole 65*c* is a slit shaped through hole, which is formed with a predetermined length along a longitudinal direction of the first arm 65*a*. The second arm 65*b* extends toward the rear side of the vehicle from the third shaft 23. The handle 65*d* is provided at a distal end portion of the second arm 65*b*. The handle 65*d* protrudes, as illustrated in FIG. 1, externally from an opening 31 provided in the second casing 3. A user is able to rotate the childproof lever 65 to a child lock position and a child unlock position by holding the handle 65*d* in an open state of the door.

The childproof lever 65 that is in the child unlock position is illustrated in FIG. 5. When the childproof lever 65 is in the child unlock position, the pressing portion 61*c* of the inside lever 61 is abuttable against the coupling member 70. The inside lever 61 is rotated in an anticlockwise direction in FIG. 5 by the door opening operation on the inner handle. The pressing portion 61*c* abuts against the coupling member 70 and pushes up the coupling member 70 and the arm 64*a* to the upper side of the vehicle. The arm 64*a* has, as illustrated in FIG. 4 and FIG. 5, a pressing portion 64*c*. The pressing portion 64*c* abuts against an abutment portion 69*c* of the outside lever 69. The outside lever 69 is supported by the first casing 2 so as to be freely rotatable around an axis of rotation XX illustrated in FIG. 4. The pressing portion 64*c* presses the abutment portion 69*c* toward the upper side of the vehicle, and rotates the outside lever 69 in the clockwise direction in FIG. 4. A coupling portion 69*b* of the outside lever 69 is coupled to an outer handle of the door. When a door opening operation is performed on the outer handle, the coupling portion 69*b* is pressed toward the lower side of the vehicle. Thereby, similarly to when the abutment portion 69*c* is pressed by the pressing portion 64*c*, the outside lever 69 is rotated in the clockwise direction in FIG. 4.

Referring back to FIG. 5, the open link 62 is able to be switched over between an unlocked position and a locked position. The open link 62 is a plate shaped member, and has a first coupling hole 62*a* and a second coupling hole 62*b*. The first coupling hole 62*a* is provided at an end portion of the open link 62, the end portion at the lower side of the vehicle. A coupling projection 69*a* of the outside lever 69 is inserted in the first coupling hole 62*a*. The coupling projection 69*a* is a plate shaped protruding portion, and is provided at an end portion of the outside lever 69, the end portion at the inner side of the vehicle. The first coupling hole 62*a* of the open link 62 allows relative rotation of the open link 62 with respect to the coupling projection 69*a*. More specifically, the first coupling hole 62*a* allows the open link 62 to rotate from the unlocked position illustrated in FIG. 5 to the locked position in the anticlockwise direction over a predetermined angular range around the coupling projection 69*a*.

The second coupling hole 62*b* is a slit shaped through hole extending in the vehicle up-down direction. The coupling projection 63*c* of the lever lock 63 is inserted in the second coupling hole 62*b*. That is, the open link 62 is coupled to the lever lock 63 via the coupling projection 63*c*, and rotates around the coupling projection 69*a* in conjunction with rotation of the lever lock 63. The second coupling hole 62*b* allows relative movement of the open link 62 in the vehicle up-down direction with respect to the coupling projection 63*c*. The open link 62 has a pressing portion 62*c*. The pressing portion 62*c* is a surface facing the upper side of the vehicle, and is provided at the upper side of the vehicle than the first coupling hole 62*a*. As illustrated in FIG. 5, when the open link 62 is in the unlocked position, the pressing portion 62*c* is opposite to a release lever 44*b* in the vehicle up-down direction. The release lever 44*b* is supported freely rotatably by the shaft 44*a* of the ratchet 44, and is connected to the ratchet 44. When the pressing portion 62*c* abuts against the release lever 44*b* and pushes up the release lever 44*b* by movement of the open link 62 toward the upper side of the vehicle, the ratchet 44 rotates in the clockwise direction in FIG. 4. Thereby, engagement between the latch 43 and the ratchet 44 is released, and the latch mechanism 4 is switched over to the unlatched state.

Therefore, if a door opening operation is performed on the inner handle when the childproof lever 65 is in the child unlock position, the inside lever 61 pushes up the coupling member 70 and the arm 64*a* of the intermediate lever 64 toward the upper side of the vehicle. Thereby, the pressing portion 64*c* of the intermediate lever 64 rotates the outside lever 69 and moves the open link 62 toward the upper side of the vehicle. The open link 62 in the unlocked position rotates the release lever 44*b* and switches over the latch mechanism 4 to the unlatched state.

Figure 7:
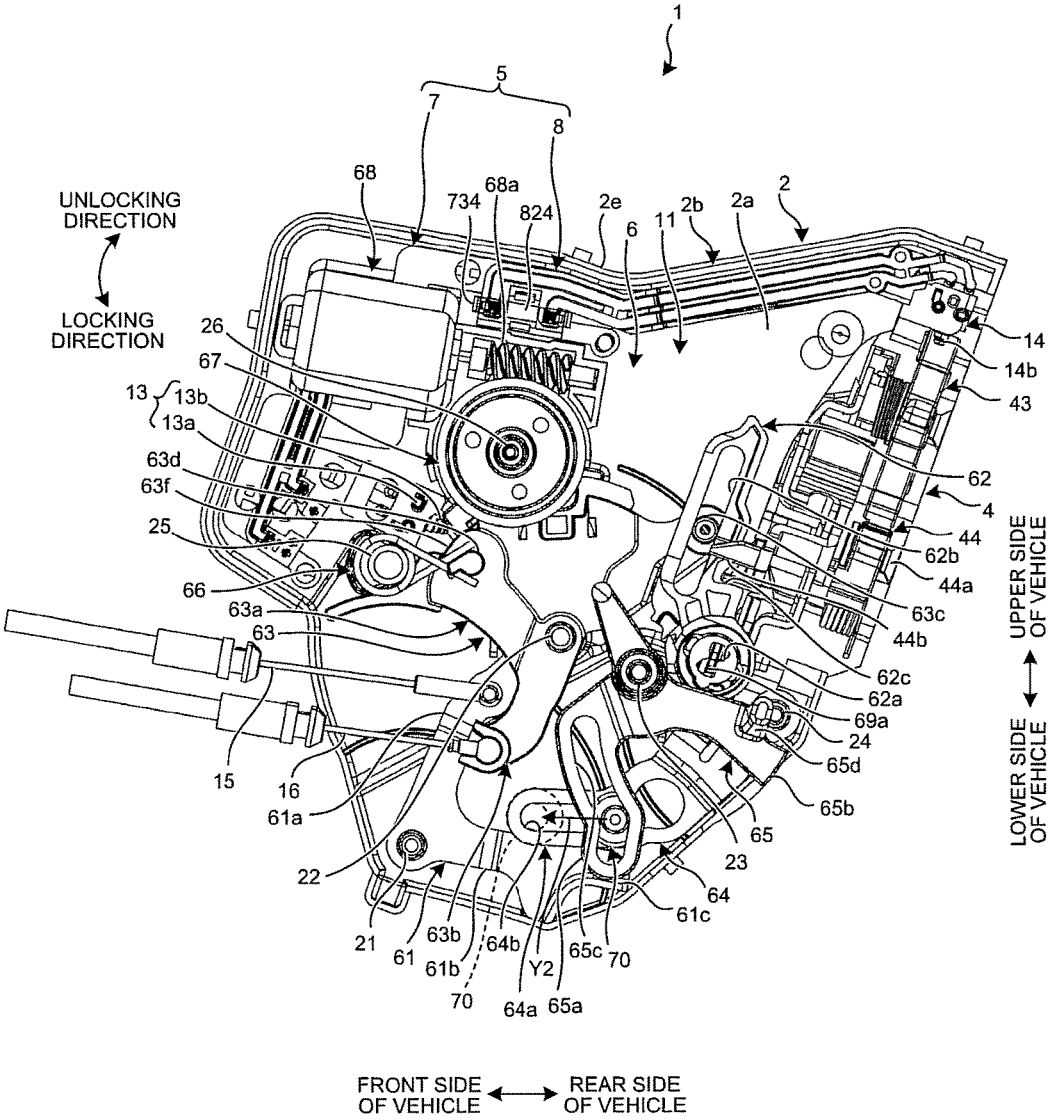
FIG. 7 is a diagram illustrating operation of a childproof lever of the embodiment.

When the childproof lever 65 rotates toward the child lock position, as illustrated with an arrow Y2 in FIG. 7, the first arm 65*a* moves the coupling member 70 toward the front side of the vehicle. When the coupling member 70 is positioned at the child lock position illustrated with broken lines in FIG. 7, the pressing portion 61*c* of the inside lever 61 becomes unable to abut the coupling member 70. Therefore, the door opening operation on the inner handle is not transmitted from the inside lever 61 to the open link 62, and the door opening operation is invalidated.

The lever lock 63 switches over between transmitting or not transmitting the door opening operation to the latch mechanism 4 according to the rotational position. When an unlocking operation is performed by a user on the lock knob, the cable 16 pulls the arm 63*b* toward the front side of the vehicle, according to that unlocking operation. Thereby, the lever lock 63 is rotated in the unlocking direction. On the contrary, when a locking operation is performed on the lock knob, the cable 16 presses the arm 63*b* toward the rear side of the vehicle, according to that locking operation. Thereby, the lever lock 63 rotates in the locking direction.

Figure 6:
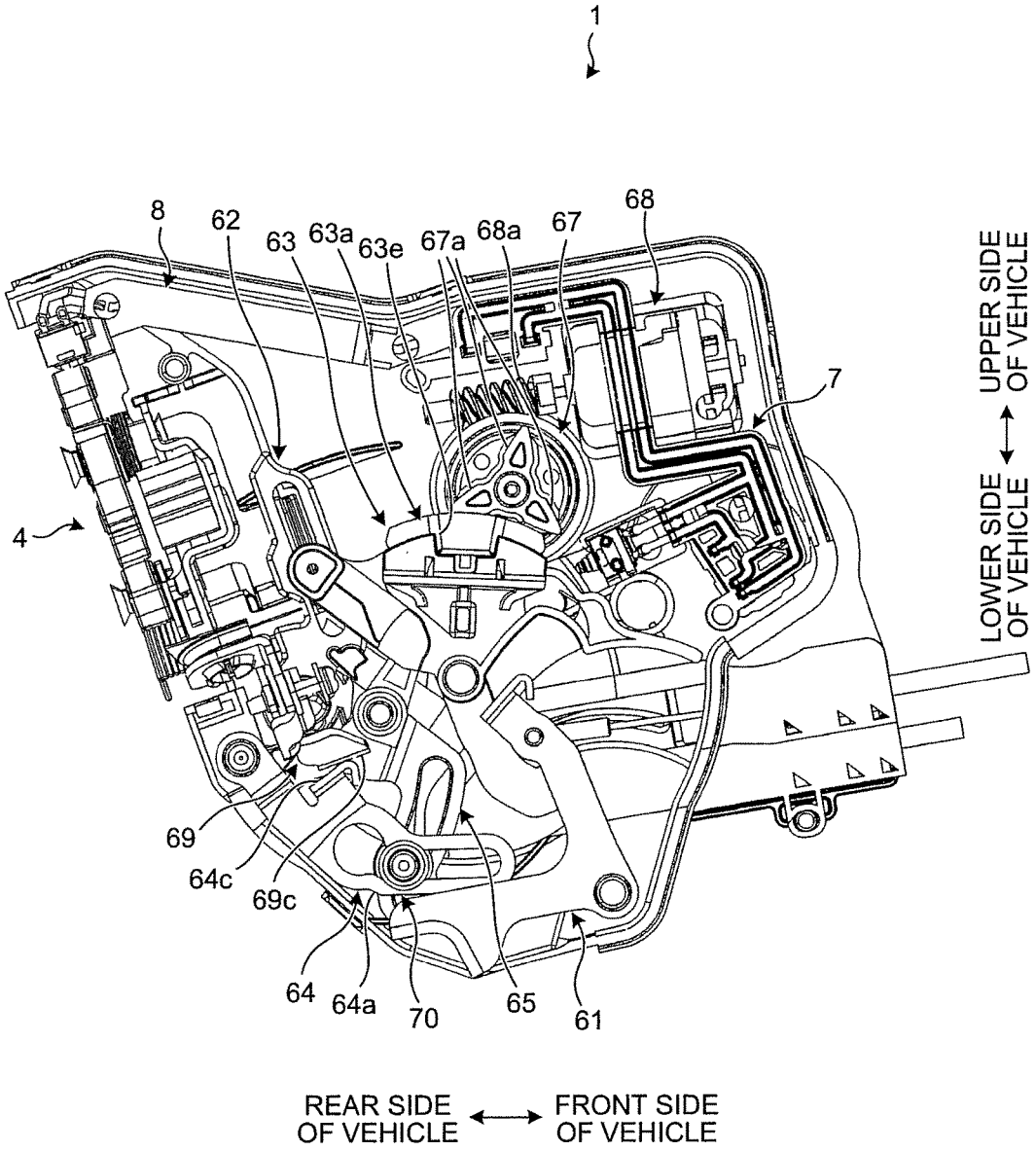
FIG. 6 is a rear view illustrating the inside of the vehicle door lock device according to the embodiment.

The worm wheel 67 rotates the lever lock 63 in the locking direction and the unlocking direction by transmitting rotation of the motor 68 to the lever lock 63. The worm wheel 67 is freely rotatably supported by a wheel shaft 26 of the first casing 2. A helical screw groove is formed on an outer peripheral surface of the worm wheel 67, and this screw groove engages with a worm 68*a* of the motor 68. As illustrated in FIG. 6, the worm wheel 67 has a projection 67*a*. The projection 67*a* in a plan view thereof is substantially triangular shaped, and width of the projection 67*a* becomes narrower outward in a radial direction. The worm wheel 67 of this embodiment has three projections 67*a* arranged at equal intervals in a circumferential direction thereof.

The plate portion 63*a* of the lever lock 63 has an engagement groove 63*e*. The engagement groove 63*e* is a concave portion formed on an outer peripheral surface of the plate portion 63*a*, that is, a surface opposite to the wheel shaft 26. The projections 67*a* of the worm wheel 67 engages with the engagement groove 63*e*, and presses the plate portion 63*a* in the locking direction and the unlocking direction. That is, the motor 68 drives the lever lock 63 in the locking direction and the unlocking direction via the worm wheel 67.

As illustrated in FIG. 4, FIG. 5, and the like, the second switch 14 is arranged adjacently to the latch 43, and detects rotational position of the latch 43. The second switch 14 of this embodiment is an adjuster switch, and detects that the rotational position of the latch 43 is a position other than the fully latched position. The second switch 14 detects whether or not the rotational position of the latch 43 is more toward an unlatched position than a position between the fully latched position and the half latched position. When the rotational position of the latch 43 is detected by the second switch 14 to be a position other than the fully latched position (the door is ajar or released), a room lamp in the vehicle is turned on. The second switch 14 is arranged at the upper side of the vehicle with respect to the latch 43. The second switch 14 has a main body 14*a*, and a needle 14*b*. The main body 14*a* is fixed to the first casing 2 via a second holding member 82 described later. The needle 14*b* is a column shaped member having a distal end portion that is spherically curved. The needle 14*b* is supported by the main body 14*a* to be freely movable relatively in an axial direction of the needle 14*b*. The distal end portion of the needle 14*b* protrudes toward an outer peripheral surface of the latch 43 from a lower surface of the main body 14*a*. The needle 14*b* is biased toward the latch 43 by a spring not illustrated.

As illustrated in FIG. 4, when the latch 43 is in the unlatched position, a distal end of the needle 14*b* abuts against a first outer peripheral surface 43*f* of the latch 43. The first outer peripheral surface 43*f* pushes the needle 14*b* into the main body 14*a* against the biasing force of the spring. When the needle 14*b* has been pushed into the main body 14*a*, the second switch 14 outputs a release signal (for example, an ON signal) indicating that the rotational position of the latch 43 is toward the unlatched position than the position between the fully latched position and the half latched position. On the contrary, when the rotational position of the latch 43 is in the fully latched position, a second outer peripheral surface 43*g* of the latch 43 is opposite to the needle 14*b*. A distance from the shaft 43*a* to the second outer peripheral surface 43*g* is less than a distance from the shaft 43*a* to the first outer peripheral surface 43*f*. When the latch 43 is in the fully latched position, the needle 14*b* is in a state of protruding toward the second outer peripheral surface 43*g* by the biasing force of the spring. When the needle 14*b* is protruding, the second switch 14 outputs an engagement signal (for example, an OFF signal) indicating that the rotational position of the latch 43 is in the fully latched position.

As illustrated in FIG. 5 and the like, the first switch 13 is arranged adjacently to the lever lock 63, and detects the rotational position of the lever lock 63. The first switch 13 of this embodiment detects whether or not the rotational position of the lever lock 63 is in the locked position. The first switch 13 is arranged at the front side of the vehicle with respect the plate portion 63*a* of the lever lock 63. The first switch 13 has a main body 13*a*, and a needle 13*b*. The main body 13*a* is fixed to the first casing 2 via a first holding member 73 described later. The needle 13*b* is a column shaped member having a distal end portion that is spherically curved. The needle 13*b* is supported by the main body 13*a* to be freely movable relatively in an axial direction of the needle 13*b*. The distal end portion of the needle 13*b* protrudes toward a side surface 63*f* of the plate portion 63*a* from a side surface of the main body 13*a*, the side surface at the rear side of the vehicle. The needle 13*b* is biased toward the side surface 63*f* by a spring not illustrated.

As illustrated in FIG. 5, when the lever lock 63 is in the unlocked position, the side surface 63*f* of the plate portion 63*a* is separate from the needle 13*b* of the first switch 13. Thus, the needle 13*b* of the first switch 13 is in a state of protruding toward the side surface 63*f* by the biasing force of the spring. When the needle 13*b* is protruding from the main body 13*a*, the first switch 13 outputs an unlock signal (for example, an OFF signal) indicating that the rotational position of the lever lock 63 is in the unlocked position. On the contrary, when the lever lock 63 is in the locked position, the side surface 63*f* of the plate portion 63*a* abuts against the needle 13*b* and pushes the needle 13*b* into the main body 13*a* against the biasing force of the spring. When the needle 13*b* has been pushed into the main body 13*a*, the first switch 13 outputs a lock signal (for example, an ON signal) indicating that the rotational position of the lever lock 63 is in the locked position.

The motor 68 and the first switch 13 are arranged at a front portion in the vehicle front-rear direction in the casing 10. The motor 68 and the first switch 13 are arranged at a relatively front side of the vehicle with respect to the lever lock 63. Thereby, wirings for the motor 68 and the first switch 13 are able to be put together at the front side of the vehicle in the casing 10.

As illustrated in FIG. 1, a connecting portion 3*a*, to which a connector for connection to an external device equipped at a vehicle side is connected, is exposed from the second casing 3. A connector of a wiring, such as a wire harness, is connected to the connecting portion 3*a*. Via the wiring connected to the connecting portion 3*a*, the vehicle door lock device 1, and a control device or a control circuit, such as an electronic control unit (ECU) that controls the vehicle door lock device 1, are electrically connected to each other. The connecting portion 3*a* is arranged at a front portion in the vehicle front-rear direction on an outer surface of the second casing 3. The connecting portion 3*a* has a fitting portion 3*b*, an engagement projection 3*c*, a first slit 3*d*, and a second slit 3*e*. A distal end portion of the connector is inserted in the fitting portion 3*b*. The engagement projection 3*c* is a claw portion protruding from a wall surface of the fitting portion 3*b*. The engagement projection 3*c* fixes the connector by engaging with the connector inserted in the fitting portion 3*b*. The engagement projection 3*c* is a retaining portion that engages with a concave portion formed in the connector. The first slit 3*d* and the second slit 3*e* are slit shaped through holes that communicate between the inside and the outside of the casing 10.

As illustrated in FIG. 5, the vehicle door lock device 1 has the connecting unit 5. The connecting unit 5 electrically connects the above described connecting portion 3*a*, to the motor 68, the first switch 13, and the second switch 14. The connecting unit 5 has a first connecting unit 7 and a second connecting unit 8. The first connecting unit 7 is arranged at a front portion in the vehicle front-rear direction in the casing 10, and connects the connecting portion 3*a*, to the motor 68 and the first switch 13. The second connecting unit 8 is arranged at a rear portion in the vehicle front-rear direction in the casing 10, and connects between the first connecting unit 7 and the second switch 14.

Figure 8:
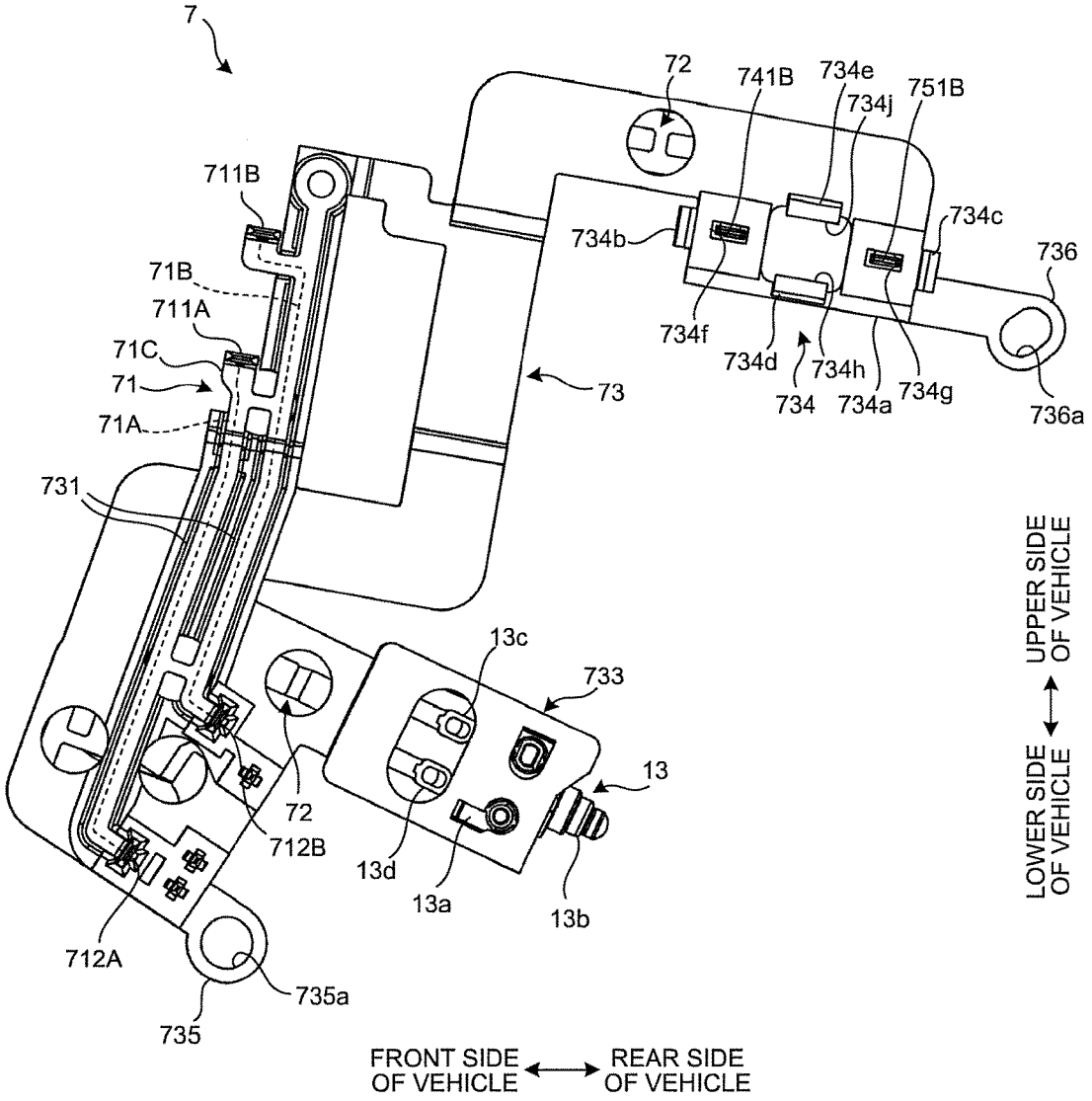
FIG. 8 is a front view of a first connecting unit of the embodiment.
Figure 9:
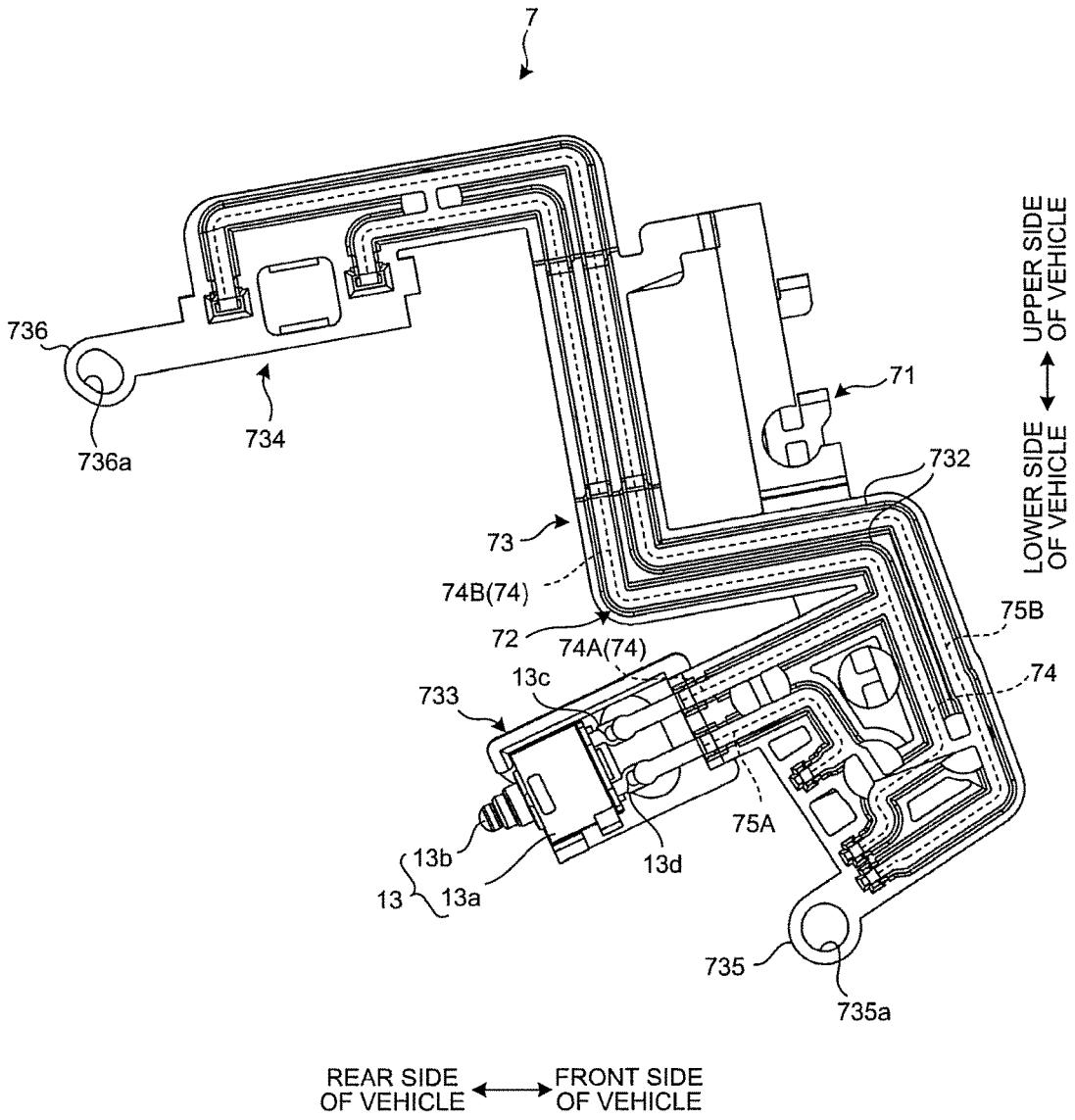
FIG. 9 is a rear view of the first connecting unit of the embodiment.
Figure 10:
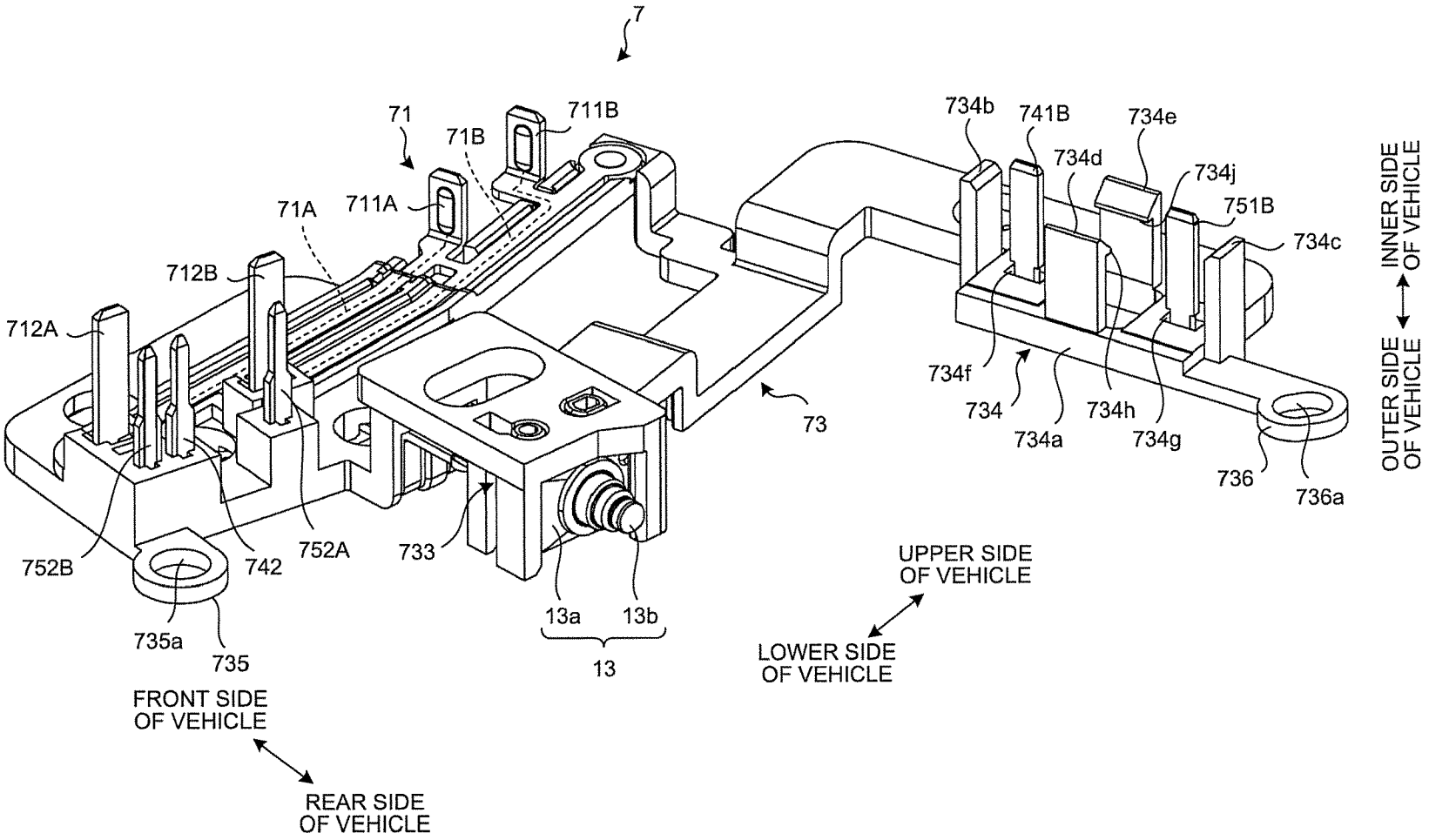
FIG. 10 is a perspective view of the first connecting unit of the embodiment.

The first connecting unit 7 has, as illustrated in FIG. 8 to FIG. 10, a motor connecting unit 71, a switch connecting unit 72, and a first holding member 73. The motor connecting unit 71 is a power supply line that connects between the connecting portion 3*a* and the motor 68. The motor connecting unit 71 has a first connection line 71A, a second connection line 71B, and a coating 71C. The first connection line 71A is connected to one of input terminals of the motor 68, and the second connection line 71B is connected to the other input terminal of the motor 68. Electric current having a direction according to a rotating direction of the motor 68 is supplied to the motor 68 via the first connection line 71A and the second connection line 71B. The coating 71C is an insulative coating that covers the first connection line 71A and the second connection line 71B. The motor connecting unit 71 extends along the vehicle up-down direction. Each of the first connection line 71A and the second connection line 71B is a conductive plate shaped member, such as copper. The first connection line 71A and the second connection line 71B are formed by, for example, being punched out by a press.

As illustrated in FIG. 10, an end portion (terminal) 711A of the first connection line 71A, the end portion 711A at the upper side of the vehicle, is bent toward the inner side of the vehicle. Similarly, an end portion (terminal) 711B of the second connection line 71B, the end portion 711B at the upper side of the vehicle, is bent toward the inner side of the vehicle. The terminals 711A and 711B are connected to different terminals of the motor 68, respectively. An end portion (terminal) 712A of the first connection line 71A, the end portion 712A at the lower side of the vehicle, is bent toward the inner side of the vehicle. Similarly, an end portion (terminal) 712B of the second connection line 71B, the end portion 712B at the lower side of the vehicle, is bent toward the inner side of the vehicle. Distal end portions of the terminals 712A and 712B protrude, as illustrated in FIG. 1, toward an outer side of the casing 10 from the first slit 3*d*. Each of the terminals 711A, 711B, 712A, and 712B is not covered by the coating 71C, and is exposed.

Figure 11:
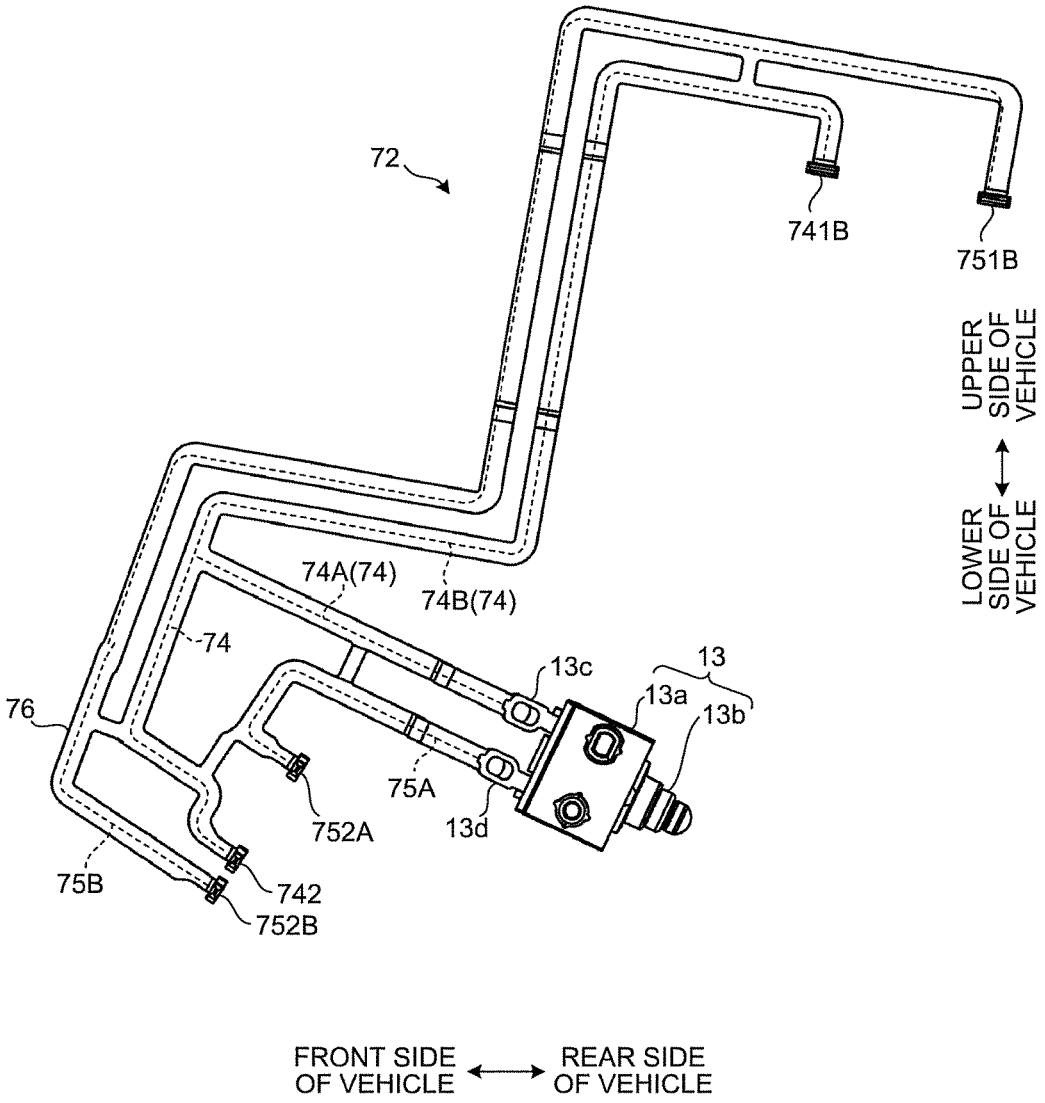
FIG. 11 is a front view of a switch connecting unit of the first connecting unit.

The switch connecting unit 72 connects between the connecting portion 3*a* and the first switch 13, and connects between the connecting portion 3*a* and the second connecting unit 8. As illustrated in FIG. 11, the switch connecting unit 72 has an input line 74, a first output line 75A, a second output line 75B, and a coating 76. Each of the input line 74, the first output line 75A, and the second output line 75B is a conductive plate shaped member, such as copper, and is formed by, for example, being punched out by a press. The coating 76 is an insulative coating that covers the input line 74, the first output line 75A, and the second output line 75B. A predetermined voltage is supplied from an external device to the input line 74. The input line 74 is branched into a first input line 74A and a second input line 74B. The first input line 74A is connected to an input terminal 13*c* of the first switch 13 by resistance welding or the like. The second input line 74B is connected to the second connecting unit 8. The first output line 75A is connected to an output terminal 13*d* of the first switch 13 by resistance welding or the like. The second output line 75B is connected to the second connecting unit 8.

Figure 12:
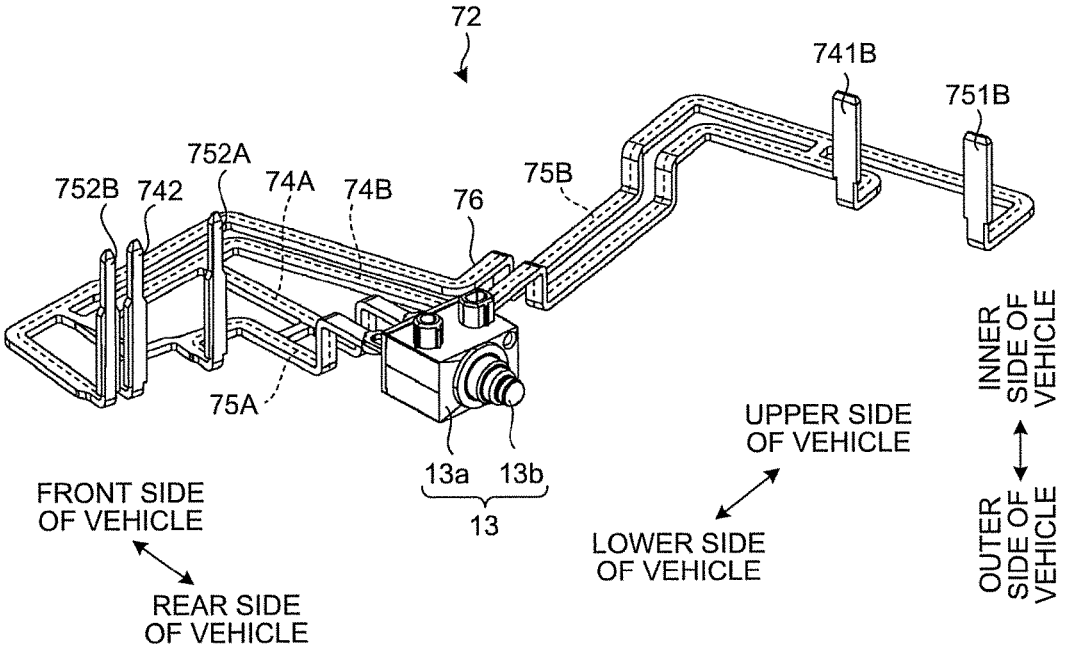
FIG. 12 is a perspective view of the switch connecting unit of the first connecting unit.

As illustrated in FIG. 12, an end portion (terminal) 741B of the second input line 74B, the end portion 741B at the upper side of the vehicle, is bent toward the inner side of the vehicle. An end portion (terminal) 751B of the second output line 75B, the end portion 751B at the upper side of the vehicle, is bent toward the inner side of the vehicle. Further, an end portion (terminal) 742 of the input line 74, the end portion at the lower side of the vehicle, and end portions (terminals) 752A and 752B of the respective output lines 75A and 75B, the end portions at the lower side of the vehicle, are respectively bent toward the inner side of the vehicle. As illustrated in FIG. 1, the terminals 742, 752A, and 752B protrude toward the outer side of the casing 10 from the second slit 3*e*. The terminals 742, 752A, and 752B are not covered by the coating 76, and are exposed.

As illustrated in FIG. 8 to FIG. 10, the motor connecting unit 71 and the switch connecting unit 72 are each held by the first holding member 73. The first holding member 73 of this embodiment is integrally molded with resin. The first holding member 73 has a groove 731 (see FIG. 8) corresponding to the motor connecting unit 71, and a groove 732 (see FIG. 9) corresponding to the switch connecting unit 72. The motor connecting unit 71 is held in the groove 731. The switch connecting unit 72 is held in the groove 732. The connecting unit 71 and 72 are fixed to the first holding member 73 by, for example, press fitting or thermal caulking. The respective grooves 731 and 732 may have plural pairs of holding projections that hold the connecting unit 71 and 72 from both width direction sides thereof.

The first holding member 73 has a switch holding portion 733 that holds the first switch 13. The switch holding portion 733 positions the main body 13*a* with respect to the lever lock 63, by unmovably holding the main body 13*a* of the first switch 13. The first holding member 73 has a connector portion 734. As illustrated in FIG. 8 and FIG. 10, the connector portion 734 has a base portion 734*a*, guides 734*b* and 734*c*, and engagement portions 734*d* and 734*e*. The base portion 734*a* is a plate shaped portion with a rectangular planar shape. The base portion 734*a* has through holes 734*f* and 7340*g*. A terminal 741B is inserted in the through hole 734*f* toward the inner side of the vehicle from the outer side of the vehicle. A terminal 751B is inserted in the through hole 734*g* toward the inner side of the vehicle from the outer side of the vehicle. The pair of guides 734*b* and 734*c* are plate shaped components, and are formed integrally with the base portion 734*a*. The guides 734*b* and 734*c* are positioned at a front end and a rear end of the base portion 734*a*, and protrude toward the inner side of the vehicle from the base portion 734*a*. The pair of engagement portions 734*d* and 734*e* are plate shaped components, and are formed integrally with the base portion 734*a*. The engagement portions 734*d* and 734*e* are positioned at an upper end and a lower end of the base portion 734*a*, and protrude toward the inner side of the vehicle from the base portion 734*a*. On mutually opposite surfaces of the engagement portions 734*d* and 734*e*, engagement projections 734*h* and 734*j* are formed.

The first holding member 73 holds fixing portions 735 and 736. The fixing portion 735 is provided at a lower end of the first holding member 73. The fixing portion 735 has a through hole 735*a*. The fixing portion 736 is provided at an upper and rear end of the first holding member 73. The fixing portion 736 has a through hole 736*a*. When the first holding member 73 is assembled to the first casing 2, a shaft 27 (see FIG. 3) of the first casing 2 is inserted in the through hole 735*a* of the fixing portion 735, and a shaft 28 is inserted in the through hole 736*a* of the fixing portion 736. Thereby, the positioning and the fixing of the first holding member 73 with respect to the first casing 2 are done.

Figure 13:
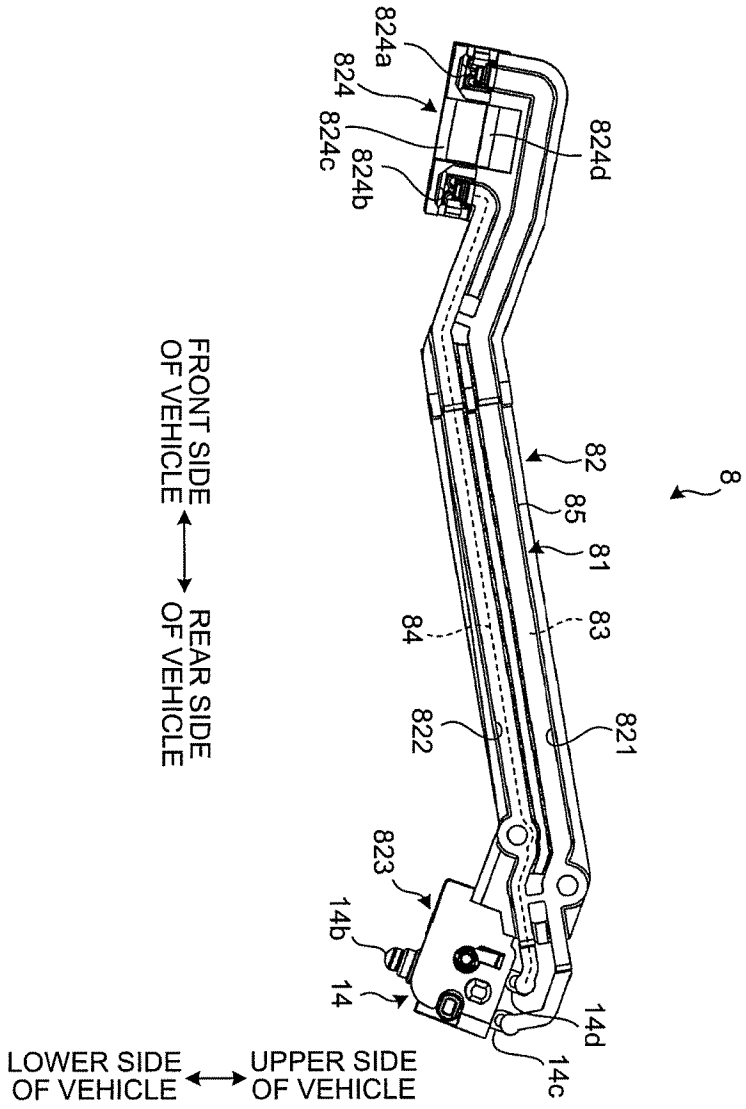
FIG. 13 is a front view of a second connecting unit of the embodiment.
Figure 14:
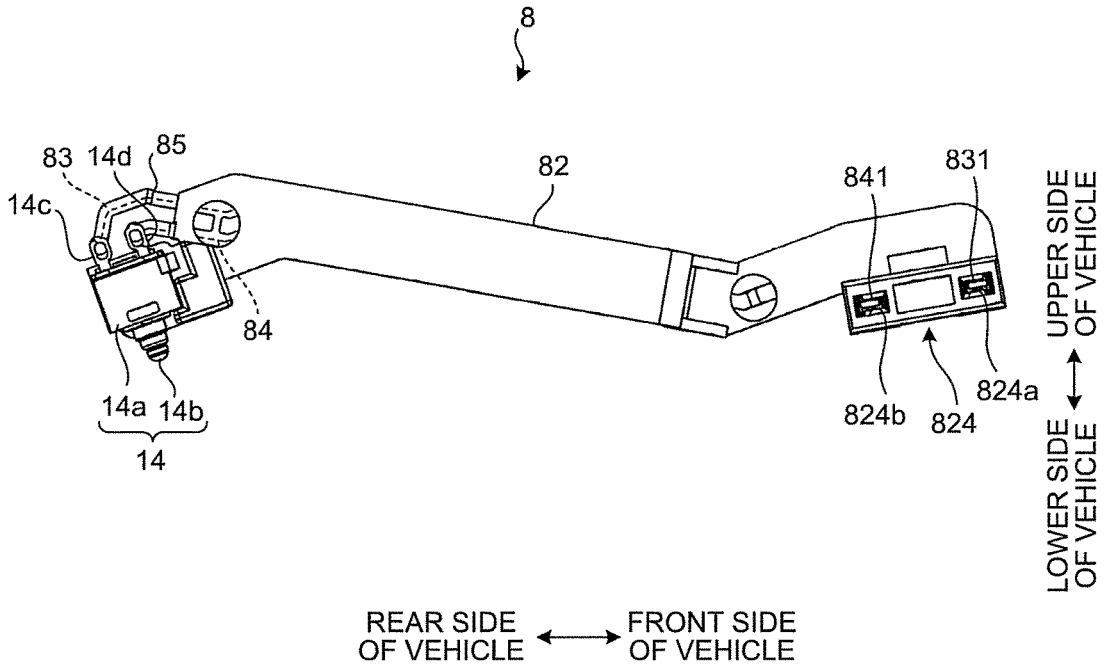
FIG. 14 is a rear view of the second connecting unit of the embodiment.
Figure 15:
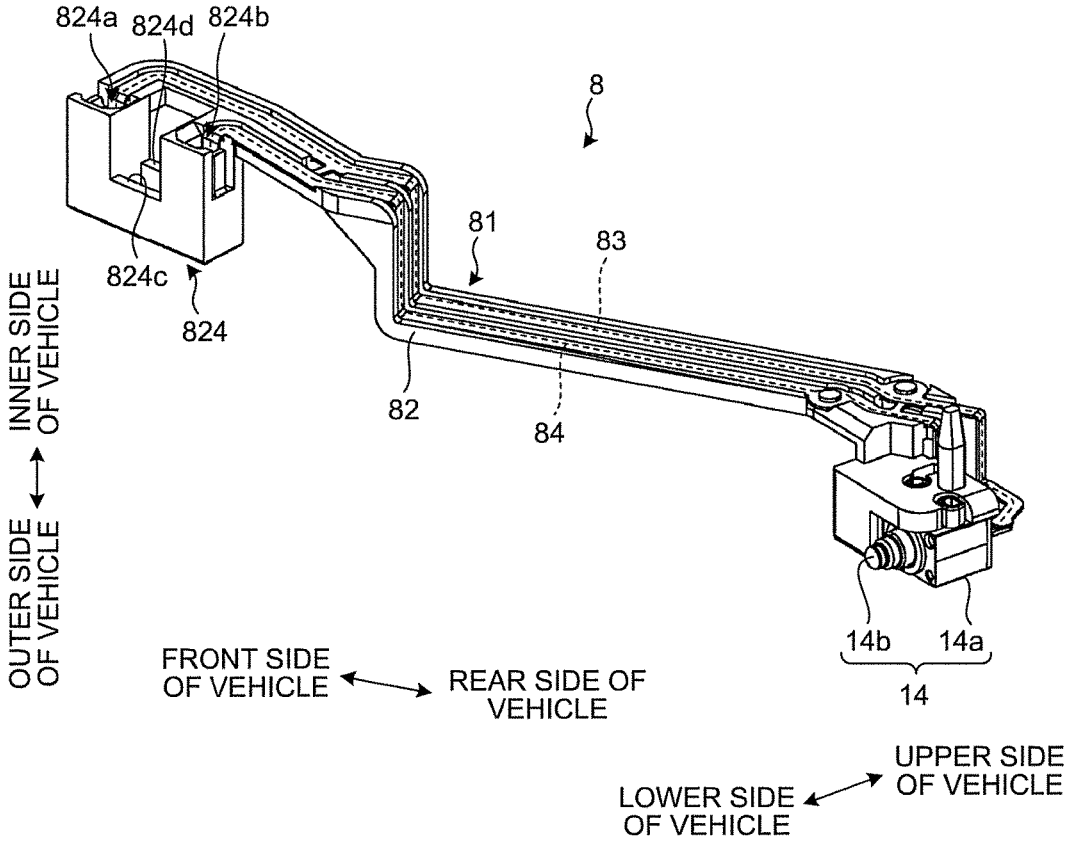
FIG. 15 is a perspective view of the second connecting unit of the embodiment.

The second connecting unit 8 has, as illustrated in FIG. 13 to FIG. 15, a switch connecting unit 81, and a second holding member 82. The second connecting unit 8 connects between the second switch 14 and the first connecting unit 7. The switch connecting unit 81 has an input line 83, an output line 84, and a coating 85. Each of the input line 83 and the output line 84 is a conductive plate shaped member, such as copper, and is formed by, for example, being punched out by a press. The coating 85 is an insulative coating that covers the input line 83 and the output line 84. One end of the input line 83 is connected to a second input line 74B of the first connecting unit 7, and the other end of the input line 83 is connected to an input terminal 14*c* of the second switch 14 by resistance welding or the like. The input line 83 supplies a predetermined voltage input via the first connecting unit 7 from an external device to the second switch 14. One end of the output line 84 is connected to an output terminal 14*d* of the second switch 14 by resistance welding or the like, and the other end of the output line 84 is connected to a second output line 75B of the first connecting unit 7. The output line 84 transmits an output signal of the second switch 14 to the first connecting unit 7.

Figure 16:
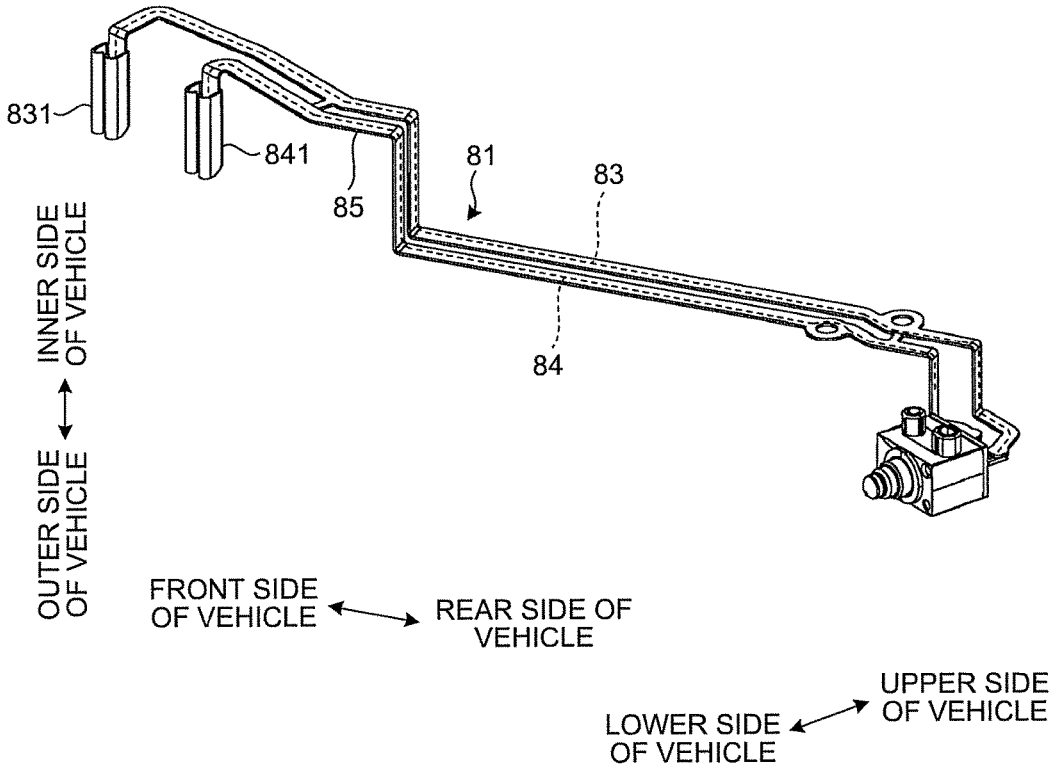
FIG. 16 is a perspective view of a switch connecting unit of the second connecting unit.

As illustrated in FIG. 16, a terminal 831 is formed at an end portion of the input line 83, the end portion at a first connecting unit 7 side. A terminal 841 is formed at an end portion of the output line 84, the end portion at the first connecting unit 7 side. The terminals 831 and 841 have hollow quadratic prism shapes and protrude toward the outer side of the vehicle. The terminals 831 and 841 are not covered by the coating 85. As illustrated in FIG. 13 to FIG. 15, the switch connecting unit 81 is held by the second holding member 82. The second holding member 82 of this embodiment is integrally molded with resin. The second holding member 82 has a groove 821 corresponding to the input line 83, and a groove 822 corresponding to the output line 84. The input line 83 is held in the groove 821, and the output line 84 is held in the groove 822. The input line 83 and the output line 84 are fixed to the second holding member 82 by, for example, press fitting or thermal caulking. The respective grooves 821 and 822 may have plural pairs of holding projections that hold the input line 83 and the output line 84 from both width direction sides thereof.

The second holding member 82 has a switch holding portion 823 and a connector portion 824. The switch holding portion 823 is formed at an end portion of the second holding member 82, the end portion at the rear side of the vehicle. The switch holding portion 823 positions the main body 14*a* with respect to the latch 43 by unmovably holding the main body 14*a* of the second switch 14. The connector portion 824 is coupled to the connector portion 734 of the first connecting unit 7. As illustrated in FIG. 15 and the like, the connector portion 824 has an outer shape that is substantially cuboidal, and is formed at an end portion of the second holding member 82, the end portion at the front side of the vehicle. Fitting holes 824*a* and 824*b*, and notched portions 824*c* and 824*d* are formed in the connector portion 824. The fitting holes 824*a* and 824*b* penetrate through the connector portion 824 in the vehicle inner-outer direction. The terminal 831 of the input line 83 is fitted in the fitting hole 824*a* from the inner side of the vehicle. The terminal 841 of the output line 84 is fitted in the fitting hole 824*b* from the inner side of the vehicle.

When the connector portion 734 of the first connecting unit 7 and the connector portion 824 of the second connecting unit 8 are coupled to each other, the terminal 741B (see FIG. 10) of the second input line 74B is inserted in the fitting hole 824*a* from the outer side of the vehicle, and the terminal 751B of the second output line 75B is inserted in the fitting hole 824*b* from the outer side of the vehicle. In the fitting hole 824*a*, the terminal 831 and the terminal 741B are held in a contact state. In the fitting hole 824*b*, the terminal 841 and the terminal 751B are held in a contact state. The engagement projections 734*h* and 734*j* of the connector portion 734 engage with the notched portions 824*c* and 824*d* of the connector portion 824.

The second connecting unit 8 is coupled to the first connecting unit 7 by the coupling between the connector portions 734 and 824, and is supported by the first casing 2 via the first connecting unit 7. Further, the second connecting unit 8 is held by an inner surface of the second casing 3 from the inner side of the vehicle. When the connecting unit 5 is assembled to the casing 10, for example, the second connecting unit 8 may be coupled to the first connecting unit 7 after the first connecting unit 7 has been assembled to the first casing 2, or the first connecting unit 7 may be assembled to the first casing 2 after the first connecting unit 7 and the second connecting unit 8 have been coupled to each other. From the viewpoint of improving the assembly efficiency, the latter assembly sequence, which requires assembly accuracy that is not high, is favorable.

As described above, the connecting unit 5 of the vehicle door lock device 1 of this embodiment is divided into the first connecting unit 7 and the second connecting unit 8.

Thereby, waste of the material upon manufacture of the input lines 74 and 83, the output lines 75B and 84, and the like is able to be reduced. For example, because the input wiring connecting between the connecting portion 3*a* and the second switch 14 is divided into the input line 74 of the first connecting unit 7 and the input line 83 of the second connecting unit 8, shapes of the input lines 74 and 83 are simplified. Thereby, waste of the material in punching of the input lines 74 and 83 is reduced. Further, because the output wiring connecting between the connecting portion 3*a* and the second switch 14 is divided into the second output line 75B of the first connecting unit 7 and the output line 84 of the second connecting unit 8, waste of the material in punching of the output lines 75B and 84 is reduced. Furthermore, since the connecting unit 5 has the divided structure, assembly efficiency and reliability are improved. For example, because room for absorbing positional errors due to variations in the respective parts is increased, assembly time is able to be shortened.

Further, the first connecting unit 7 is arranged in a region at the upper and front side of the vehicle in the casing 10. Furthermore, the second connecting unit 8 is arranged in a region at the upper and rear side of the vehicle in the casing 10. Because the respective connecting unit 7 and 8 are arranged in the regions at the upper side of the vehicle in the casing 10, even if water enters the casing 10, the connecting unit 7 and 8 are hard to be affected. The second connecting unit 8 is arranged along a wall portion 2*e* of an upper end of the casing 10 in the vehicle up-down direction. The second connecting unit 8 of this embodiment has an advantage of being hard to be affected by the entrance of water. The second connecting unit 8 is desirably arranged at the upper side of the vehicle than the respective components of the locking and unlocking mechanism 6, for example, the motor 68, the lever lock 63, the open link 62, and the like.

Further, in the vehicle door lock device 1 of this embodiment, the first connecting unit 7 and the second connecting unit 8 are connected to each other at an upper end portion in the vehicle up-down direction in the casing 10. As illustrated in FIG. 5 and the like, the connector portion 734 of the first connecting unit 7 and the connector portion 824 of the second connecting unit 8 are coupled to each other at an upper end portion of the first accommodating unit 11. More specifically, the connector portion 734 and the connector portion 824 are coupled to each other immediately above the worm 68*a* of the motor 68. Because the connector portions 734 and 824 are arranged at the upper end portion in the casing 10, even if water enters the casing 10, influence of the entrance of water on the electrically connecting portion between the first connecting unit 7 and the second connecting unit 8 is effectively reduced.

Further, the vehicle door lock device 1 of this embodiment has a waterproof cover 17 that covers the casing 10. The waterproof cover 17 is a water-impermeable cover member that covers the first casing 2 and the second casing 3 integrally with each other. The waterproof cover 17 covers an edge portion at an upper portion and an edge portion at the front side of the vehicle, the edge portions of the casing 10. The waterproof cover 17 protects the connecting unit 5 by preventing water from entering the casing 10.

In the vehicle door lock device 1 of this embodiment, when a switch corresponding to the second switch 14 is provided at the vehicle side, the second connecting unit 8 may be omitted and the first connecting unit 7 may be used. This case is able to be realized by using the components of the connecting unit 5, excluding the second connecting unit 8. Therefore, parts are common between the case where the second switch 14 is used and the case where the second switch 14 is not used.

Modifications of Embodiment

Modifications of the embodiment will now be described. In the above described embodiment, instead of the connection via the input lines 74 and 83 and the output lines 75A, 75B, and 84, harness connection or jumper wire connection may be used. In such a method of connection, connection lines are preferably connected to the switches 13, 14, and the like by resistance welding. The connecting portion 3*a* may be provided integrally with, or provided separately from, the casing 10. For example, a connecting portion corresponding to the connecting portion 3*a* of the above described embodiment may be provided in a switch plate in the casing 10, and may be exposed from an opening of the casing 10.

The contents disclosed in the above described embodiment and modifications may be executed in combination with one another as appropriate.

REFERENCE SIGNS LIST

1 VEHICLE DOOR LOCK DEVICE
2 FIRST CASING
2*a* FIRST OUTER WALL PORTION
2*b* FIRST SIDE WALL PORTION
2*c* SECOND OUTER WALL PORTION
2*d* SECOND SIDE WALL PORTION
3 SECOND CASING
3*a* CONNECTING PORTION
3*b* FITTING PORTION
3*c* ENGAGEMENT PROJECTION
3*d* FIRST SLIT
3*e* SECOND SLIT
4 LATCH MECHANISM
5 CONNECTING UNIT
6 LOCKING AND UNLOCKING MECHANISM
7 FIRST CONNECTING UNIT
8 SECOND CONNECTING UNIT
10 CASING
11 FIRST ACCOMMODATING UNIT
12 SECOND ACCOMMODATING UNIT
13 FIRST SWITCH
13*a* MAIN BODY
13*b* NEEDLE
14 SECOND SWITCH
14*a* MAIN BODY
14*b* NEEDLE
15, 16 CABLE
17 WATERPROOF COVER
21 FIRST SHAFT
22 SECOND SHAFT
23 THIRD SHAFT
24 FOURTH SHAFT
25 SPRING SHAFT
26 WHEEL SHAFT
41 BODY
42 COVER PLATE
43 LATCH
43*d* PROJECTING PORTION
43*f* FIRST OUTER PERIPHERAL SURFACE
44 RATCHET
61 INSIDE LEVER
61*a* FIRST ARM
61*b* SECOND ARM

61*c* PRESSING PORTION
62 OPEN LINK
63 LEVER LOCK
63*a* PLATE PORTION
63*b* ARM
63*c* COUPLING PROJECTION
63*d* ENGAGEMENT PROJECTION
63*e* ENGAGEMENT GROOVE
64 INTERMEDIATE LEVER
64*a* ARM
64*b* COUPLING HOLE
64*c* PRESSING PORTION
65 CHILDPROOF LEVER
66 OVER CENTER SPRING
67 WORM WHEEL
68 MOTOR
69 OUTSIDE LEVER
70 COUPLING MEMBER
71 MOTOR CONNECTING UNIT
72 SWITCH CONNECTING UNIT
73 FIRST HOLDING MEMBER
731, 732 GROOVE
733 SWITCH HOLDING PORTION
734 CONNECTOR PORTION
74 INPUT LINE
74A FIRST INPUT LINE
74B SECOND INPUT LINE
75A FIRST OUTPUT LINE
75B SECOND OUTPUT LINE
76 COATING
81 SWITCH CONNECTING UNIT
82 SECOND HOLDING MEMBER
821, 822 GROOVE
823 SWITCH HOLDING PORTION
824 CONNECTOR PORTION
83 INPUT LINE
84 OUTPUT LINE
85 COATING

The invention claimed is:

1. A vehicle door lock device comprising:

a connecting portion to which a connector for connection to an external device is connected;

a casing;

a latch mechanism that is arranged at a rear end portion of the casing in a vehicle front-rear direction and includes a latch and a ratchet;

a locking and unlocking mechanism arranged in the casing, the locking and unlocking mechanism including:

a lever lock that switches between transmitting or not transmitting a door opening operation to the latch mechanism according to a rotational position; and a motor that drives the lever lock;

a first switch that detects a rotational position of the lever lock;

a second switch that detects a rotational position of the latch; and a connecting unit that electrically connects the connecting portion to the motor, the first switch and the second switch, wherein the connecting portion is arranged at a front portion in the vehicle front-rear direction on an outer surface of the casing, the motor and the first switch are arranged at a front portion in the vehicle front-rear direction in the casing, and the connecting unit includes:

a first connecting unit that is arranged at a front portion in the vehicle front-rear direction in the casing and connects the connecting portion to the motor and the first switch; and a second connecting unit that is arranged at a rear portion in the vehicle front-rear direction in the casing and connects between the first connecting unit and the second switch.

2. The vehicle door lock device according to claim 1, wherein the second connecting unit is arranged along a wall portion of an upper end of the casing in a vehicle up-down direction.

3. The vehicle door lock device according to claim 1, wherein the first connecting unit and the second connecting unit are connected to each other at an upper end portion in the vehicle up-down direction in the casing.

4. The vehicle door lock device according to claim 1, wherein the second switch detects that the rotational position of the latch is a position other than a fully latched position.

5. The vehicle door lock device according to claim 2, wherein the first connecting unit and the second connecting unit are connected to each other at an upper end portion in the vehicle up-down direction in the casing.

6. The vehicle door lock device according to claim 2, wherein the second switch detects that the rotational position of the latch is a position other than a fully latched position.

7. The vehicle door lock device according to claim 3, wherein the second switch detects that the rotational position of the latch is a position other than a fully latched position.

8. The vehicle door lock device according to claim 5, wherein the second switch detects that the rotational position of the latch is a position other than a fully latched position.

* * * * *